United States Patent [19]

Aumercier

[11] Patent Number: 5,037,230

[45] Date of Patent: Aug. 6, 1991

[54] LINKAGE ASSEMBLIES FOR HORIZONTALLY AND VERTICALLY PIVOTAL CLOSURES

[75] Inventor: M. Laurent Aumercier, Phalsbourg, France

[73] Assignee: Ferco International, Sarrebourg, France

[21] Appl. No.: 362,655

[22] Filed: Jun. 7, 1989

[30] Foreign Application Priority Data

Jun. 13, 1988 [FR] France ..... 88 08046

[51] Int. Cl.[5] ..... E05D 15/30

[52] U.S. Cl. ..... 403/53; 49/248; 49/252

[58] Field of Search ..... 403/53, 54, 116; 49/248, 252, 251, 250

[56] References Cited

U.S. PATENT DOCUMENTS

| | | | |
|---|---|---|---|
| 2,921,819 | 1/1960 | Rifkin | 403/54 X |
| 3,797,169 | 3/1974 | Armstrong | 49/248 |
| 4,364,201 | 12/1982 | Taylor | 49/248 |
| 4,703,540 | 11/1987 | Davis | 49/250 X |
| 4,718,144 | 1/1988 | Buckley | 49/252 X |
| 4,833,754 | 5/1989 | Yang | 49/252 X |
| 4,838,111 | 6/1989 | Schmidt | 403/53 X |

FOREIGN PATENT DOCUMENTS

| | | |
|---|---|---|
| 2940049 | 5/1981 | Fed. Rep. of Germany . |
| 8117446 | 8/1981 | Fed. Rep. of Germany . |
| 0204267 | 5/1986 | Fed. Rep. of Germany . |
| 3601278 | 7/1987 | Fed. Rep. of Germany . |
| 0112681 | 12/1983 | United Kingdom . |

*Primary Examiner*—Peter M. Cuomo

*Attorney, Agent, or Firm*—Sandler, Greenblum & Bernstein

[57] ABSTRACT

Linkage assemblies for doors or windows, in which the leaf frame is partly lap-jointed to the fixed frame, where an upper and lower assembly are respectively fixed in fillisters, both assemblies of which include an auxiliary compass arm. The upper and lower assemblies are each also fitted with a second compass arm of which one extremity is mounted slidingly in the lower and upper rail of the fixed frame. The configuration of the assemblies enable the offsetting, in the course of French opening, the rear stile of the leaf frame in the relation to the rear stile of the fixed frame. The doors or window, which can be of considerable size and weight, nevertheless are securely supported for the aforementioned movement, including movement about a vertical axis through an angle of opening of more than ninety degrees.

17 Claims, 3 Drawing Sheets

LINKAGE ASSEMBLIES FOR HORIZONTALLY AND VERTICALLY PIVOTAL CLOSURES

BACKGROUND OF THE INVENTION

The invention concerns joint fittings, or linkage assemblies for tipping and turning doors, windows or similar closures, i.e., such closures being selectively pivotal about either a vertical or horizontal axis, of which the leaf frame is partly lap-jointed with the window casing frame, composed of a stop compass and an angle bracket fixed in fillisters and both comprising an auxiliary compass arm linked, one the one hand, to the upper, or respectively lower rail of the window casing frame and, on the other hand, to the main compass arm cooperating with the upper rail of the leaf frame or, respectively, to the lower rail of the latter.

Joint fittings for tipping doors or windows housed in fillisters of the leaf frame and of the window casing frame and corresponding to the above description are already known.

Thus, these fittings are composed of a joint element known as a stop compass, associated with the upper part of the door or window, their function consisting, on the one hand, of ensuring the rotation of the leaf around a vertical axis in a French window opening and, on the other hand, of limiting the tipping of this leaf in the tipped position.

They comprise, in addition, another joint element known as an angle bracket, placed in the lower part of the door or window and permitting, alternatively, a tipping of the leaf around a horizontal axis and a pivoting of the leaf around a vertical axis of rotation.

For aesthetic reasons, but also to improve security, the present trend is to insert these jointing elements in fillisters of the leaf and of the window casing frame of the door or window.

Thus, a known assembly includes a stop compass formed of a main compass arm, the extremities of which are mounted sliding, respectively, on the upper rail of the leaf and the upper rail of the window casing frame. In addition, a first link is placed between the compass arm and the leaf frame, and a second link connects the same compass arm to the window casing frame.

Also known is an angle bracket composed of, on the one hand, a vertical spindle inserted in the extremity of the lower rail of the leaf, hinge side, and comprising a roller, mounted sliding in a slide fixed on the lower rail of the window casing. On the other hand, a link connects the latter to the leaf.

The effect of this device is to cause the staggering, following movement in a direction parallel to the plane of the door or window, of the axis of rotation of the leaf in French window opening, and in this way to disengage the rear stile of this leaf in relation to the window frame.

In the case of opening by tipping, only the existing play of the spindle, fitted with its roller, in the slide situated on the window case, permits the leaf to pivot around a horizontal axis.

In fact, the solution corresponding to this known angle bracket and stop compass corresponds only to doors or windows, the leaf of which is flush with the window frame. In the case of partial lap-jointing, and because of the position in the fillisters of the imaginary axis of rotation of the leaf, it is necessary, in French window openings, to offset this imaginary axis of rotation outside the vertical plane of the door or window.

For this purpose, stop compasses and angle brackets have been designed which are more or less identical to those described above, and which also comprise an auxiliary compass arm connected by means of jointing to either the upper or lower rail of the window frame and to the rear extremity of the main compass arm to the lower rail of the leaf. This layout, however, has imposed the sliding mounting of the various links referred to above on this lower rail of the leaf or on the main compass arm.

The result is that, at the moment a French window is opened, the rotation of the auxiliary compass arm causes the staggering, in relation to the window frame, of the rear stile of the leaf and, simultaneously, the offsetting of the imaginary axis of rotation of the latter outside the plane of the door or window, more precisely towards the interior of the dwelling.

Although providing a solution to the problem of leaves partially lap-jointed to the window frame, described above, these joint fittings nevertheless have a disadvantage, i.e. their application is limited to leaves of reduced size and weight.

Because of the offset of the leaf outside the window frame, in a French window opening, the auxiliary compass arm and the link of the angle bracket have to support the whole weight of the leaf. These constraints tend to increase in proportion to the angle of opening of the door or window. Moreover, the proximity of the joints connecting the link and the auxiliary compass arm to the window frame raises security problems if their fixing is torn off the respective support, in particular in the maximum French window opening position.

Solutions have been proposed to compensate for the load constituted by the leaf fixed with such recessed locking fittings. In particular, a supplementary compass arm has been added to the angle bracket in the attempt to create a point of connection to the window frame distant from the imaginary axis of rotation of the leaf and, in particular, of the joint of the auxiliary compass arm connecting it to the lower rail of this window frame. In addition, this supplementary compass arm is inserted, at one of its extremities, sliding on the lower rail of the leaf.

Now an assembly of this kind necessarily limits the angle of French window opening to ninety degrees, which in fact constitutes an inconvenience.

SUMMARY OF THE INVENTION

The aim of this invention is to overcome the abovementioned disadvantages by proposing joint fittings for tipping doors or windows of a design that is simple and reliable but also provides a solution to the problem of the weight of large leaves.

For this purpose, the invention concerns joint fittings for tipping windows or doors of which the leaf frame is partially lap-jointed to the window frame, composed of a stop compass and an angle bracket fixed in the fillisters, and both comprising an auxiliary compass arm connected, on the one hand, to the upper or respectively lower rail of the window frame and, on the other hand, to the main compass arm cooperating with the upper rail of the leaf frame or, respectively, to the lower rail of the latter, these joint fitting being characterized by the fact that the stop compass and the angle bracket comprise:

a second compass arm mounted sliding at one of its extremities on the upper or, respectively, the lower rail of the window frame, the other extremity being linked, by means of jointing, to this main compass arm or, respectively, to the lower rail of the leaf frame and a link of which one extremity is jointed to this second compass arem, the other extremity being fixed pivoting on the upper or respectively lower rail of the window frame.

The advantages obtained through this invention consist essentially in the fact that the sliding connection of the second compass arm to the upper or lower rail of the window frame permits the point of attachment it constitutes to the window frame to be removed as far as possible from the point of articulation of the auxiliary compass arm on the same upper and lower rails. This gives a better distribution of the load constituted by the leaf on these joint fittings and, more particularly, on the angle bracket.

This advantage is not obtained, however, at the expense of the angle of rotation of the leaf in a French window opening, since the angle can reach values of considerably more than ninety degrees.

In addition, the advantage of joint fixings of identical design to achieve both the lower and upper connection of a tipping leaf to the window frame of the door or window is that it permits some of their elements to be standardized, and this simplifies manufacture and stocking.

BRIEF DESCRIPTION OF THE DRAWINGS

Othe aims and advantages of this invention will be made apparent in the following description. This description will be easier to understand if reference is made to the attached drawings, in which.

DETAILED DESCRIPTION OF THE PREFERRED EMBODIMENTS

Figure 1:
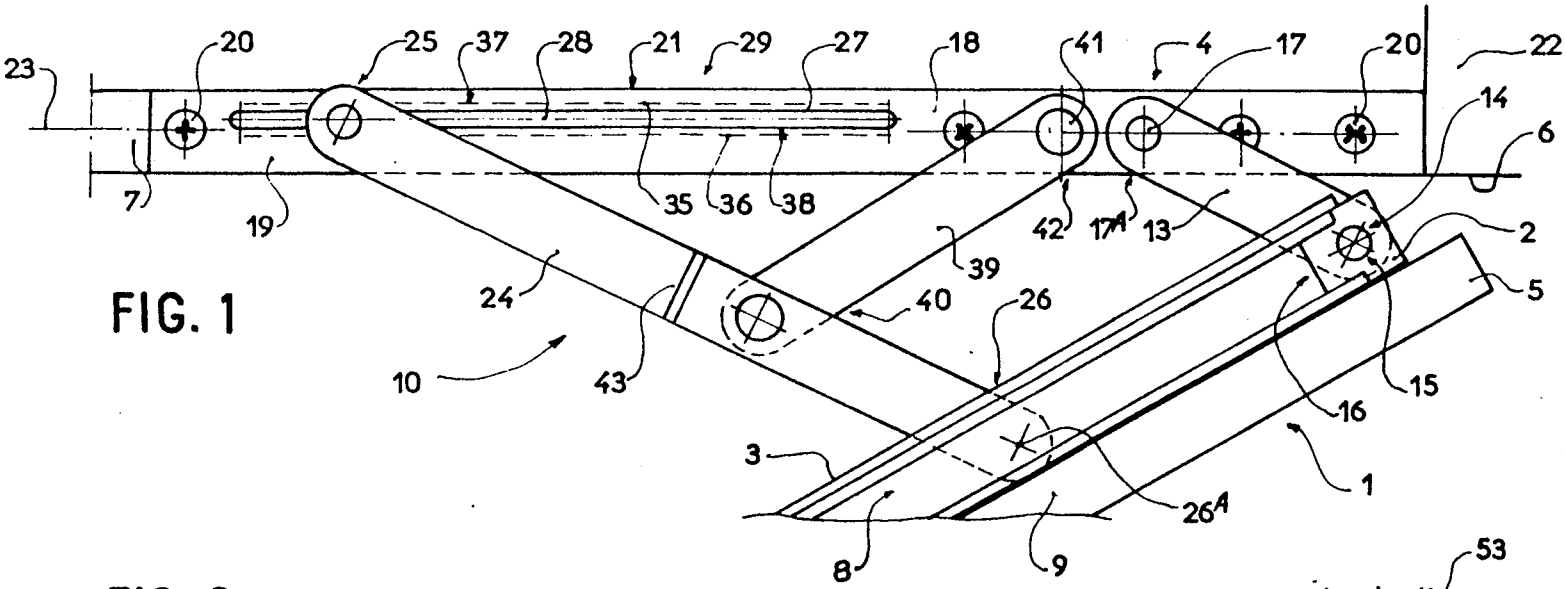
FIG. 1 is a schematic plan view of an angle bracket according to the invention and applied to a door or window of which the leaf is in the French window opening position.

The joint fittings according to the invention and represented in FIGS. 1 to 4 are applicable to doors or windows of which the leaf 1 is of the tipping type and for which leaf 1 is able to pivot around a vertical axis, passing by the rear stile 2 and corresponding to the so-called French opening position. Moreover, the leaf 1 can tip around a horizontal axis, frequently realized by its lower rail 3, this opening corresponding to the tipped position.

Among the different tipping and turning leaves, we distinguish those partially lap-jointed to the window frame 4. Such leaves 1 have on their periphery an edge 5 which, in the closed position, is applied against the inner face 6 of the window frame 4, thus improving the sealing of the door or window.

This invention applies, more precisely, to such leaves, and concerns joint fittings placed in fillisters 7, 8 of the window frame 4 and of the leaf frane 9.

These joint fittings are composed of an angle bracket 10 providing the lower linkage assembly of the leaf 1 to the window frame 4, and a stop compas 11 constituting the upper linkage assembly of the this way, the angle bracket 10 makes it possible to confer on the leaf 1 both a rotation around a vertical axis and a rotation around a horizontal axis, while the stop compass 11 assures the pivoting around a vertical axis of the main compass 12 which, because of its link to the leaf 1, passes on this rotation to the latter. In addition, this stop compass 11 makes it possible to limit the angle of tipping of the leaf 1 when it rotates around the horizontal axis.

Figure 2:
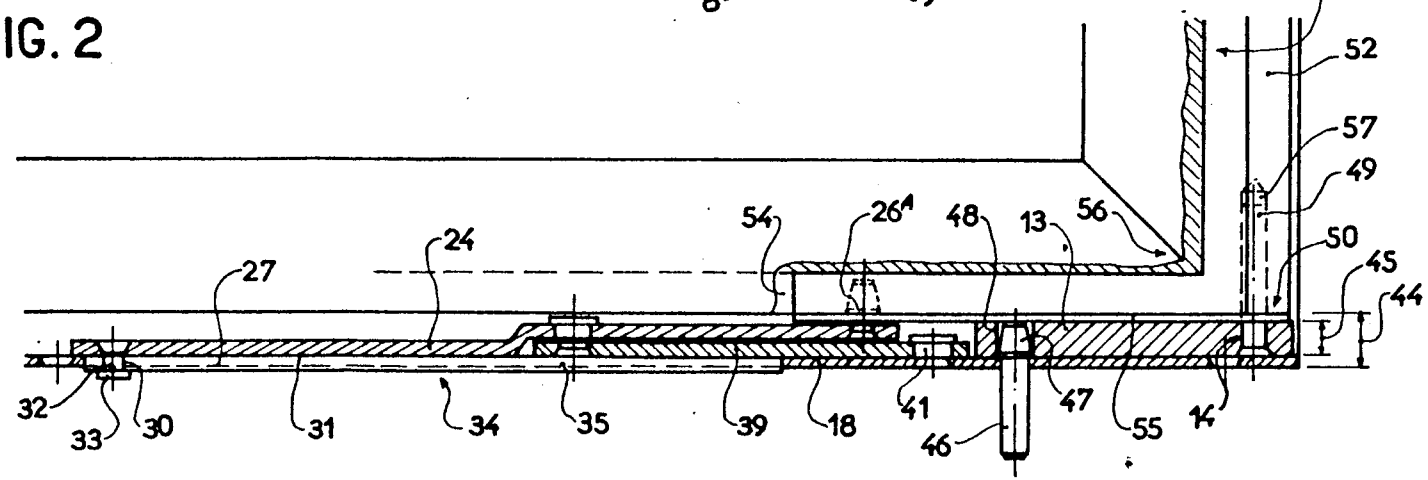
FIG. 2 is a schematic view in section of the angle bracket represented in FIG. 1.

More exactly, the angle bracket 10, as represented in FIGS. 1 and 2 comprises, on the one hand, an auxiliary compass arm 13 connected, at one of its extremities 14, with the aid of means of jointing 15, to the lower rail 3 of the leaf frame 9. Preferentially, the connection of the auxiliary compass arm to the leaf 1 is situated as closely as possible to the lower angle 16 of the latter. A joint 17 connects the auxiliary compass arm 13 to the window frame 4 and, in particular, to a support 18 formed by an elongated plate 19 inserted, with the aid of fixing elements 20, in the fillisters 7 on the lower rail 21 of this window frame 4.

The main purpose of the auxiliary compass arm 13 consists, during French opening, in clearing the rear stile 2 of the leaf 1 in relation to the rear stile 22 of the window frame 4 and, simultaneously, offsetting this leaf 1 according to a direction perpendicular to the vertical plane 23 of the door or window. This offset is made, preferably, in the direction of the interior of the dwelling.

It should in fact be noted that because of the placing of joint fittings in fillisters, it is indispensable to confer on a leaf partially lap-jointed with the window frame 4 kinematics of this kind, without which its peripheral edge 5 cooperates with the inner face 6 of the window frame 4 and prevents it from rotating around a vertical axis, thus preventing French opening.

On the other hand, the angle bracket 10 comprises, according to one characteristic of the invention, a second compass arm 24 linking the leaf frame 9 to the window frame 4. More precisely, the second compass arm 24 is slidably mounted, at one of its extremities 25, on the lower rail 21 of the window frame 4, while the other extremity 26 is fixed, by a joint 26A, in fillister 8 and on the lower rail 3 of the leaf frame 9.

According to a preferential mode of implementation, the sliding mounting of the second compass arm 24 on the window frame 4 is obtained by means of a slide 27 disposed in the support 18 applied on the lower rail 21 of the window frame 4. This slide 27 consists of an oblong opening 28 disposed in the plate 19 and, in particular, in its front part 29 oriented towards the front stile of the window frame 4. Engaged in the opening 28 is a pivot 30 fixed to the extremity 25 of the second compass arm 24 and projecting from the lower face 31 of the latter. This pivot 30 is also fitted, at its free extremity 32, with a cheek 33 cooperating with the lower side 34 of the plate 19. In this way it avoids the sudden disengagement of the second compass arm 24 from the slide 27 during the manipulation of the leaf 1.

Preferentially, edges 35, 36 are disposed on the lower side 34 of the plate 19, at the level of the longitudinal edges 37, 38 of the opening 28. This characteristic makes it possible significantly to improve the quality of the guiding of the pivot 30, thus contributing to a reduction of the play between the different parts constituting the angle bracket 10. This this improvement, however, in no case results in increasing the thickness of the plate 19. The fact is that these edges 35, 36 can be obtained by a simple and inexpensive operation of swaging.

Advanageously, the angle bracket 10 is also fitted with a link 39 jointed, at one of its extremities 40, onto the second compass arm 24 and cooperating, by means of a joint 41, and at its opposite extremity 42 with the support 18 or the plate 19. The main function of the link 39 is to distribute the action of the compass arms 13 and 24 over the leaf 1. For this purpose, the joint 41, connecting the link 39 to the support 18, is preferably situated between the opening 28 and the means of jointing 15 of the auxiliary compass arm 13. In fact the joint 41 of the link 39 is disposed as near as possible to these means of jointing 15 so as to permit the largest possible angle of opening of the leaf 1. Because of the characteristics of this invention, the angle of opening of the leaf 1 can reach values well over ninety degrees.

It should also be noted that in the position perpendicular to the vertical plane 23 of the door or window, the leaf 1 comprises points of attachment to the window frame 4 which are relatively distant from one another. This assures perfect stability whatever the weight and the size of the leaf.

According to a preferential mode of implementation of the invention, the second compass arm 24 is cambered in its middle 43, permitting the insertion of the link 39 between this second compass arm 24 and the plate 19 in the closed position of the leaf 1. Care has been taken, however, to see that the overall thickness 44 of the angle bracket 10 is kept less than the play between the fillisters 7, 8 of the window frame 4 and the leaf frame 9, so as to avoid any recessing of one or the other of the latter.

The auxiliary compass arm 13 being situated, in the closed position, in the prolongation of the second compass arm 24 and the link 39, is chosen with a thickness 45 equivalent to the sum of the latter. So this auxiliary compass arm 13 is strengthened and can thus support the weight constituted by the leaf 1 when the latter is offset outside the vertical plane 23 of the door or window.

In the same objective of giving mechanical resistance to the angle bracket 10, in case of the application of the invention to large and heavy leaves, the joint 17 connecting the auxiliary compass arm 13 to the window frame 4 is formed by a vertical spindle 46 introduced amply into the lower rail 21 of the latter. Moreover, the extremity 47 of this vertical spindle 46, projecting from the support 18, is engaged in a boring 48 made in the extremity 17A of this auxiliary compass arm 13.

Figures 3, 4:
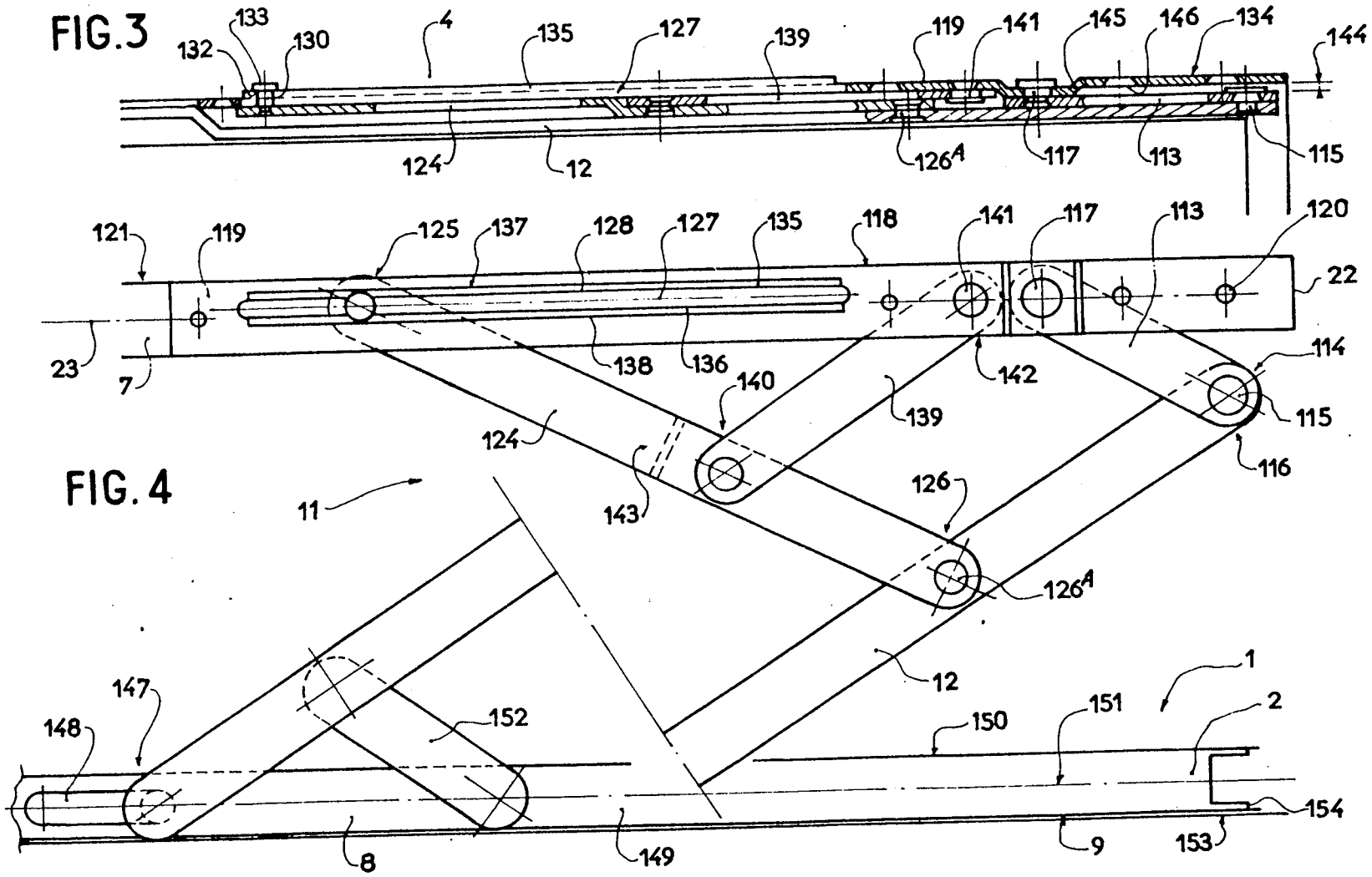
FIG. 3 is a schematic view in elevation and in section of a stop compass according to the invention and applied to a door or window of which the leaf is in the tipped position.
FIG. 4 is a schematic plane view of the stop compass represented in FIG. 3.

Concerning the stop compass 11, apart from the main compass arm 12, it has a structure essentially identical with that of the angle bracket 10. Thus, as represented in FIGS. 3 and 4, it comprises an auxiliary compass arm 113, connected at one of its extremities 114 and by means of a joint 115 to the rear extremity 116 of the main compass arm 12. In addition, a joint 117 ensures the connection of this auxiliary compass arm 113, at its opposite extremity, to a support 118 formed by an elongated plate 119 locked, by means of fixing elements 120 in fillister 7, to the upper rail 121 of the window frame 4.

The stop compass 12 is also provided with a second compass arm 124 of which one extremity 125 is mounted sliding in a slide 127 disposed in the support 118. The other extremity 126 of the second compass arm 124 is locked to the main compass arm 12 with the aid of a joint 126A.

The structure of the slide 127 is identical with that described for the angle bracket 10. Thus, it is formed by an oblong opening 128 made in the plate 119. This comprises, on its face 134, oriented in the direction of the upper rail 121 of the window frame 4, edges 135, 136 situated on the longitudinal edges 137, 138 of the opening 128. Engaged in this slide 127 is a pivot 130 in one piece with the extremity 125 of the second compass arm 124, the pivot 130 having at its free extremity 132 a cheek cooperating with the edges 135, 136 and preventing its disengagement from the opening 128.

A link 139, mounted jointed at one of its extremities on the second compass arm 124, also connects the latter to the upper rail 121 of the window frame 4. For this purpose, the link 139 cooperates, at its extremity 142, with the support 118 by means of a joint 141 disposed in the immediate proximity of the joint 117 connecting, to this same support 118, the auxiliary compass arm 113.

The second compass arm 124 like the first compass arm, is cambered in its middle 143 permitting, in the closing position, the link 139 to be engaged between this second compass arm 124 and the plate 119. However, the auxiliary compass arm 113 is not necessarily strengthened, since it contributes only to a small extent to supporting the weight of the leaf. In these conditions, the gap 144 between the auxiliary compass arm 113 and the plate 119 is compensated by a lug 145 on the lower face 146 of the latter, and on which is mounted the joint 117.

In the context of the angle bracket 10, as well as the stop compass 11, the joints 17, 117 and 41, 141 are as close as possible to one another and disposed as near as possible to the rear stile 22 of the window frame 4.

The main compass arm 12 is connected to the leaf 1 by techniques known to any professional. Thus, the front extremity 147 is fitted with a pivot (not represented) mounted sliding in an oblong opening 148 made in a face-plate 149 disposed in fillister 8 on the upper rail 150 of the leaf frame 9. More precisely, this face-place 149 covers a groove 151 made in the periphery of the leaf 1, and in which slide control rods activated by a locking mechanism such as an espagnolette or espagnolette lock. In addition, a link 152 connects the main compass arm 12 to the leaf frame 9, preventing it from shifting in relation to the window frame 4 in the case of opening by tipping.

The maintenance of the main compass arm 12 on the face-plate in the French opening position can be assured by any known means such as keepers in one piece with the main compass arm 12. In this way, the keepers are able to cooperate with locking devices fixed on a control rod and emerging from the faceplate 149 through openings made for this purpose. However, because of the space occupied by the stop compass 11 in fillisters 7, 8 of the window frame 4 and of the leaf frame 9, it would be necessary considerably to stagger these keepers in relation to the vertical axis of rotation of the leaf 1. Now in these condiitions, the least play between the keeper and the locking device disposed on the control rod results, for leaves of considerable breadth, in a play of several millimeters in the area of their rear stile.

Figure 10:
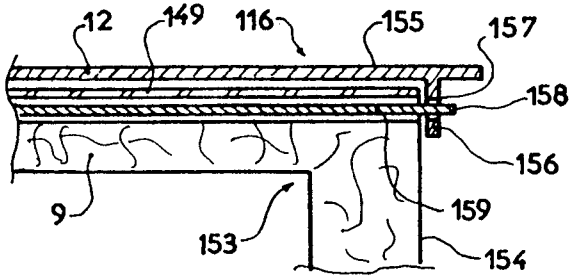
FIG. 10 is a detail view of the upper angle of the leaf frame represented in schematized form and in section.

To overcome this disadvantage, as represented in FIG. 10, the rear extremity 116 of the main compass arm 12 is elongated by a section folded back in the form of an angular lever which, in the French opening position, caps the upper angle 153 of the leaf frame 9 and, in particular, of the face-plate 149. In the vertical wing 156 of this section folded back in the form of an angular lever, an opening 157 is made, in which is engaged the extremity 158 of a control rod 159, emerging from the rear vertical edge 154 of the leaf frame 9. Conversely, the operation of the espagnolette or espagnolette lock, during tipping opening, causes the withdrawal of the protruding extremity 158 of the control rod 159, thus freeing the main compass arm 12.

Concerning the pivoting of the leaf frame 9 in relation to the window frame 4, parallel to a horizontal plane of rotation, it can be made possible due to sufficient play at the level of the joint 17 connecting the auxiliary compass arm 13 to the support 18.

More precisely, the salient extremity 47 of the spindle 46 which has been referred to in the description above, is of conical shape and introduced into the boring 48 made in the extremity 17A of the auxiliary compass arm 13. This configuration permits the latter to pivot in a limited angle through a horizontal plane axis.

In these conditions, the means of jointing 15 connecting this same auxiliary compass arm 13 to the leaf 1, consist of a vertical spindle 49, locked at its lower extremity 50 to the free extremity 14 of the auxiliary compass arm 13. In adittion, an angular lever 52 caps the lower angle 16 of the leaf 1 and fits into the recesses 53, 54 made in the rear stile 2 and the lower rail 3 of the leaf 1 and serving to house the control rods and the faceplate. The angular lever 52 is locked to the leaf 1 by fixing elements such as screws or similar means and comprises, in its lower edge 55 and in the angle 56, a cylindrical recess of dimensions adjusted to those of the spindle 49 to permit the latter to pass and to rotate.

In certain cases, particularly for ranges of more or less large leaves, this play at the level of the connection of the auxiliary compass arm 13 to the support 18 can represent a disadvantage by causing more rapid fatigue of the parts constituting the joint fittings.

In these conditions, and according to another mode of implementation according to the invention and represented in FIGS. 5 to 9, the salient extremity 47 of the spindle 46 is adjusted to the diameter of the boring 48 in the auxiliary compass arm 13 in such as way as to permit the latter to rotate only about a horizontal axis.

In addition, the vertical spindle constituting part of the means of joining 15 of the auxiliary compass arm 13 to the leaf frame 9 is introduced into an oblong opening 57A machined in the lower edge 55 and in the angle 56 of the angular lever 52. This oblong opening 57A communicates with a recess 58, preferably cylindrical, having a vertical axis and made formed in the vertical wing 59 of the angular lever 52. A socket 60, in one piece with a transmission rod 61, slides in the recess 58 and cooperates with the vertical spindle 49.

More precisely, the socket 60 has on its lower face 62 a recessed hole 63 adjusted to the diameter of the vertical spindle 49 to permit its introduction.

The transmission rod 61, connected to the socket 60, emerges from the recess 58 at the level of the upper edge 64 of the vertical wing 59 corresponding to the angular lever 52. The transmission rod 61 is thus able to cooperate, at its upper extremity 65 and with the aid of means of connection 66, with a control rod (not represented). This is housed in the recess 53 made in the rear stile 2 of the leaf 1 and cooperates with the locking mechanism, such as an espagnolette or espagnolette lock.

Hence, from the action of this control rod, operated by the locking mechanism, the socket 60 is made to slide in the recess 58 of the angular lever, cooperating or otherwise, according to the case, with the vertical spindle 49. More exactly, in the closed position of the leaf 1, corresponding to FIG. 7, the socket 60 is totally engaged in the vertical spindle 49. By activating the locking mechanism to bring about the French opening of the door or window, the play of the control rods causes the socket 60 to rise, thus being maintained in position partially engaged in the vertical spindle 49 as may be seen in FIG. 8. In this case the vertical spindle 49 is able to pivot about a vertical axis.

Figure 9:
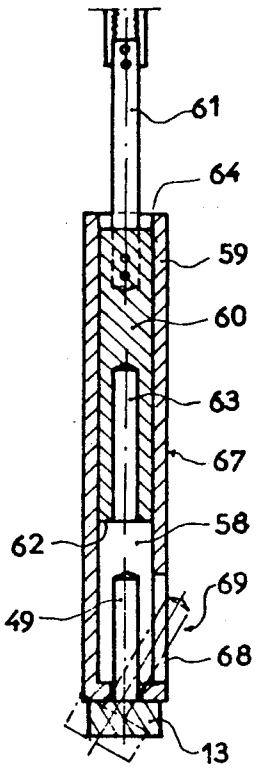
FIG. 9 is a view identical with FIGS. 6 and 7 above, the leaf being in the tipped opening position.
Figure 8:
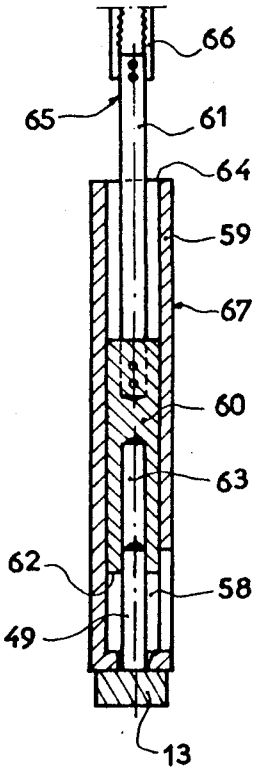
FIG. 8 is a view identical with FIG. 7, the leaf being in the French window opening position.
Figure 7:
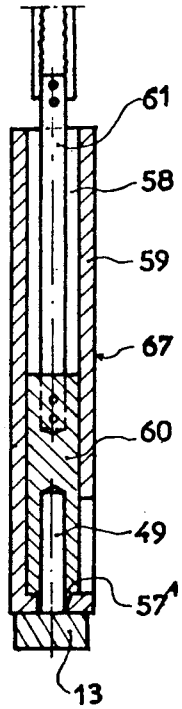
FIG. 7 is a schematic view in section of the means of jointing linking, at the level of the angle bracket, the auxiliary compass arm to the leaf frame, the latter being in the locked position.
Figures 5, 6:
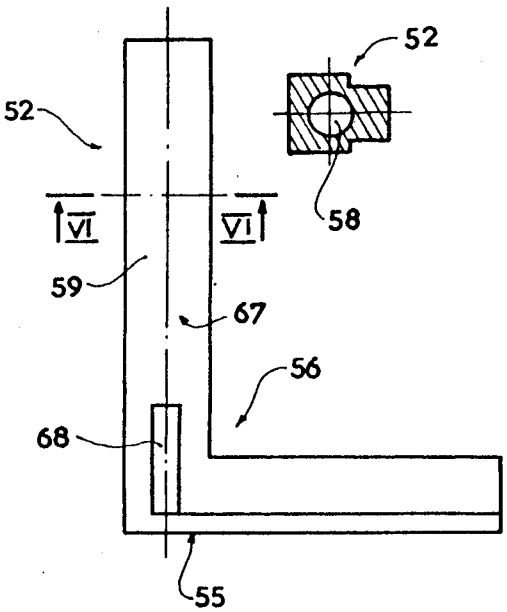
FIG. 5 is a schematic view in elevation of the angular lever which fixes in the lower angle of the leaf frame and forms one of the elements constituting the means of jointing connecting the auxiliary compass arm to this leaf frame.
FIG. 6 is a view in section along VI—VI of FIG. 5.

Finally, in the tipping opening position of the leaf 1, corresponding to the configuration of the means of jointing 15 as shown in FIG. 9, the socket 60 is totally lifted in the recess 58, freeing the vertical spindle 49.

Hence, and because of the oblong opening 57A made in the angular lever 52, the latter can pivot around a horizontal axis. However, to avoid limiting the angular displacement of the vertical spindle 49 within the recess 58, the angular lever 52, and in particular the vertical wing 59 has, close to the angle 56 and on its face 67 oriented towards the outside of the door or window, an opening 68. The latter, thus disposed to the right of the vertical spindle 49, allows the free extremity 69 of the spindle to emerge from the angular lever 52 in the maximum tipping position of the leaf 1.

A configuration such as this undeniably improves the behavior of the leaf frame 9 in relation to the window frame 4 in the case of French opening of the door or window.

Consequently, the angle bracket 10 and the stop compass 11, according to this invention, contribute undeniable advantages in the field of recessed joint fittings for tipping and turning doors or windows. Their particular design allows them to be applied to leaves of considerable size and weight with impeccable reliability, at the same time assuring an angle of French opening of more than ninety degrees. Hence these joint fittings according to the invention combine effectiveness with aesthetic qualities.

I claim:

1. A linkage assembly for a closure having at least one leaf which is movably mounted relative to a fixed frame from a closed position in which said leaf is lap-jointed to said fixed frame, to an open position, wherein said leaf is selectively pivotable about a horizontal or a vertical axis, said linkage assembly comprising:

(a) an upper linkage assembly comprising:

(i) a main compass arm connected to said leaf;

(ii) a first upper auxiliary compass arm pivotally connected to said main compass arm and pivotally connected to said fixed frame;

(iii) a second upper compass arm pivotally connected to said main compass arm and slidably connected to said fixed frame; and (iv) an upper link pivotally connected to said second upper compass arm and pivotally connected to said fixed frame; and (b) a lower linkage assembly comprising:

(i) a first lower auxiliary compass arm pivotally connected to a lower portion of said leaf and pivotally connected to a lower portion of said fixed frame;

(ii) a second lower compass arm pivotally connected to said leaf and slidably connected to said fixed frame; and (iii) a lower link pivotally connected to said second lower compass arm and pivotally connected to said fixed frame.

2. The linkage assembly of claim 1, further comprising an upper fillister, within which said upper linkage assembly is at least partially enclosed, and a lower fillister, within which said lower linkage assembly is at least partially enclosed, at least in said closed position of said leaf.

3. The linkage assembly of claim 2, wherein said upper linkage assembly further comprises an upper elongated support plate fixed within said upper fillister to which said first upper auxiliary compass arm, said second upper compass arm, and said upper link are connected, and wherein said lower linkage assembly further comprises a lower elongated support plate fixed within said lower fillister to which said first lower auxiliary compass arm, said second lower compass arm, and said lower link are connected.

4. The linkage assembly of claim 3, wherein said upper support plate comprises an elongated opening, wherein said second upper compass arm has a pivot pin connected thereto which extends within said elongated opening of said upper support plate for effecting the slidable connection of said second upper compass arm to said fixed frame, and wherein said lower support plate comprises an elongated opening, wherein said second lower compass arm has a pivot pin connected thereto which extends within said elongated opening of said lower support plate for effecting the slidable connection of said second lower compass arm to said fixed frame.

5. The linkage assembly of claim 3, wherein said first upper auxiliary compass arm and said upper link, at their respective pivotal connections with said fixed frame, do not overlie one another, and wherein said first lower auxiliary compass arm and said lower link, at their respective pivotal connections with said fixed frame, do not overlie one another.

6. The linkage assembly of claim 5, wherein said upper auxiliary compass arm and said lower auxiliary compass arm extend in the direction of said upper elongated support plate and said lower elongated support plate, respectively, and wherein, in said closed position of said leaf, an end of said upper auxiliary compass arm and an end of said lower auxiliary compass arm are adapted to be adjacent a vertical stile of said fixed frame, and wherein an end of said upper link and an end of said lower link are adjacent a respective end of said upper auxiliary compass arm and a respective end of said lower auxiliary compass arm, to thereby position the connections of said upper auxiliary compass arm and said upper link to said fixed frame as close together as possible and as close as possible to said vertical stile and to thereby position the connections of said lower auxiliary compass arm and said lower link to said fixed frame as close together as possible and as close as possible to said vertical stile.

7. The linkage assembly of claim 3, wherein each of said second upper compass arm and said second lower compass arm are cambered in a middle portion, thereby permitting said upper link to be positioned between said second upper compass arm and said upper elongated support plate and thereby permitting said lower link to be positioned between said second lower compass arm and said lower elongated support plate in said closed position of said leaf.

8. The linkage assembly of claim 3, wherein the pivotal connection between said first lower auxiliary compass arm and said lower elongated support plate is formed by a vertical spindle extending through said lower elongated support plate and said first lower auxiliary compass arm.

9. The linkage assembly of claim 8, wherein said vertical spindle comprises a conical extremity which is contained within said first lower auxiliary compass arm, thereby enabling selective movement of said leaf about both of said horizontal axis and said vertical axis.

10. The linkage arm of claim 3, wherein the pivotal connection between said first lower auxiliary compass arm and said lower elongated support plate is formed by a vertical spindle extending through said lower elongated support plate and said first lower auxiliary compass arm, and wherein said vertical spindle comprises an extremity which is contained within said first lower auxiliary compass arm and which has a diameter for enabling only rotational movement of said first lower auxiliary compass arm with respect to said extremity.

11. The linkage assembly of claim 1, wherein said first upper auxiliary compass arm has a width which is at least equal to the combined widths of said second upper compass arm and said upper link, and wherein said first lower auxiliary compass arm has a width which is at least equal to the combined widths of said second lower compass arm and said lower link.

12. The linkage assembly of claim 1, wherein said leaf comprises a lower angle member fitting within a recess of a rear stile and a lower rail of said leaf, said lower angle member comprising, extending through a lower edge thereof, a cylindrical recess for receiving a vertical spindle for permitting said vertical spindle to extend and to rotate relative thereto.

13. The linkage assembly of claim 1, wherein said leaf comprises a lower angle member having a vertical wing and a horizontal wing fitting within respective recesses of a rear stile and a lower rail of said leaf, said lower angle member comprising, extending through a lower edge thereof, a cylindrical recess, wherein the pivotal connection of said first lower auxiliary compass arm to said leaf comprises said vertical spindle having a lower extremity fixed with respect to said first lower auxiliary compass arm and said vertical spindle extending within said recess, and wherein said lower angle member further comprises an opening formed in said vertical wing communicating with said cylindrical recess.

14. The linkage assembly of claim 13, wherein said pivotal connection of said first lower auxiliary compass arm to said leaf further comprises a socket slidably mounted within said vertical wing of said lower angle member for selectively engaging said vertical spindle, for preventing pivotal movement of said leaf about said horizontal axis, or disengaging said vertical spindle, for permitting pivotal movement of said leaf about said horizontal axis.

15. The linkage assembly of claim 13, wherein said pivotal connection of said first lower auxiliary compass arm to said leaf further comprises a socket slidably mounted within said vertical wing of said lower angle member and including a lower face having a recessed hole of a diameter for selectively receiving said vertical spindle, for preventing pivotal movement of said leaf about said horizontal axis, or selectively disengaging said vertical spindle, for permitting pivotal movement of said leaf about said horizontal axis, wherein said vertical wing of said lower angle member further comprises a transmission rod extending affixed to said socket and vertically extending from said lower angle member, said transmission rod being adapted to be connected to a control mechanism for effecting said selective receiving and disengaging of said socket with said vertical spindle.

16. The linkage assembly of claim 13, wherein said vertical wing of said lower angle member comprises an outward face having an opening therein which communicates with said recess, wherein an upper extremity of said vertical spindle is adapted to extend through said opening upon at least a maximum open position of said leaf pivoted about said horizontal axis.

17. The linkage assembly of claim 1, wherein said main compass arm of said upper linkage assembly comprises an extremity having a part which, for movement of said leaf about said vertical axis, caps an upper portion of said leaf, and a vertical wing including an opening for selectively receiving a control rod for preventing movement of said leaf about said horizontal axis and disengaging said control rod for permitting movement of said wing about said horizontal axis.

* * * * *